US007176367B2

(12) United States Patent
Yeh

(10) Patent No.: US 7,176,367 B2
(45) Date of Patent: Feb. 13, 2007

(54) PEN INSTRUMENT WITH CONTROLLABLE WHISTLE

(75) Inventor: Thomas Yeh, Taipei (TW)

(73) Assignee: Lucky Star Enterprise & Co., Ltd., Taipei (TW)

( * ) Notice: Subject to any disclaimer, the term of this patent is extended or adjusted under 35 U.S.C. 154(b) by 284 days.

(21) Appl. No.: 10/976,761

(22) Filed: Nov. 1, 2004

(65) Prior Publication Data

US 2006/0090628 A1 May 4, 2006

(51) Int. Cl.
*G10D 7/00* (2006.01)

(52) U.S. Cl. ..... 84/380 R; 116/137 R

(58) Field of Classification Search ..... 84/380 R, 84/375, 330; 116/137 R
See application file for complete search history.

(56) References Cited

U.S. PATENT DOCUMENTS 6,619,225 B1 * 9/2003 Presniakov et al. ..... 116/137 R
6,698,377 B1 * 3/2004 Topman et al. ..... 116/137 R
6,837,177 B2 * 1/2005 Tanaka ..... 116/137 R

* cited by examiner

*Primary Examiner*—Kimberly Lockett
(74) *Attorney, Agent, or Firm*—Rosenberg, Klein & Lee

(57) ABSTRACT

A pen instrument is provided with a controllable whistle. The whistle includes a tubular body; a sleeve connected at a rear end to a first open end of the tubular body and at a front end to a rear end of the pen instrument to connect the whistle to the pen instrument; a whistle-producing reed structure fixedly provided in an inner space of the tubular body and including a reed; and a cut-off device provided at a predetermined position on the tubular body and operable by a user to allow or cut off flowing of air through the inner space of the tubular body. A balloon is connected to a second open end of the tubular body and inflated when the cut-off device is in a position allowing air to flow through the tubular body into the balloon.

6 Claims, 6 Drawing Sheets

PEN INSTRUMENT WITH CONTROLLABLE WHISTLE

FIELD OF THE INVENTION

The present invention relates to a pen instrument, and more particularly to a pen instrument with controllable whistle.

BACKGROUND OF THE INVENTION

Conventional pen instruments were simply designed for writing. However, with the diversification of commercial products and different demands from different users, manufacturers of pens have developed diversified pens with different shapes and functions. For example, there are pens with different patterns, textures, or attached ornaments. There are even pens with light or sound emitting elements to emit light or sound.

In view that different patterns, textures, or ornaments on pens only provide visual changes in pens, and pens with light or sound emitting elements must be battery-powered to actuate electronic components of the light or sound emitting elements, it is desirable to develop a pen instrument that has integrated functions to serve as a writing instrument, an ornament, and a sound-producer.

SUMMARY OF THE INVENTION

A primary object of the present invention is to provide a pen instrument with controllable whistle that produces whistle when airflow is supplied thereto, so that the pen instrument has the function of producing sound.

Another object of the present invention is to provide a pen instrument with controllable whistle, so that a user may allow or cut off flowing of air through the whistle via an easily operable member.

A further object of the present invention is to provide a pen instrument with controllable whistle and balloon, so that the whistle not only allows the pen instrument to produce sound, but also inflates the balloon when air flows through the whistle. And, when the balloon is deflated, air flown out of the balloon also causes the whistle to produce sound.

To achieve the above and other objects, the pen instrument with a controllable whistle according to the present invention includes a pen instrument and a whistle removably connected to the pen instrument. The whistle includes a tubular body; a sleeve connected at a rear end to a first open end of the tubular body and at a front end to a rear end of the pen instrument to connect the whistle to the pen instrument; a whistle-producing reed structure fixedly provided in an inner space of the tubular body and including a reed; and a cut-off device provided at a predetermined position on the tubular body and operable by a user to allow or cut off flowing of air through the inner space of the tubular body. A balloon is connected to a second open end of the tubular body opposite to the pen instrument and inflated when the cut-off device is in a position allowing air to flow through the tubular body into the balloon. And, when the balloon is deflated, it also causes the whistle to produce sound.

The pen instrument with controllable whistle not only serves to write, but also functions as a novel ornament capable of producing sound, and is therefore helpful in giving the pen instrument an increased value.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
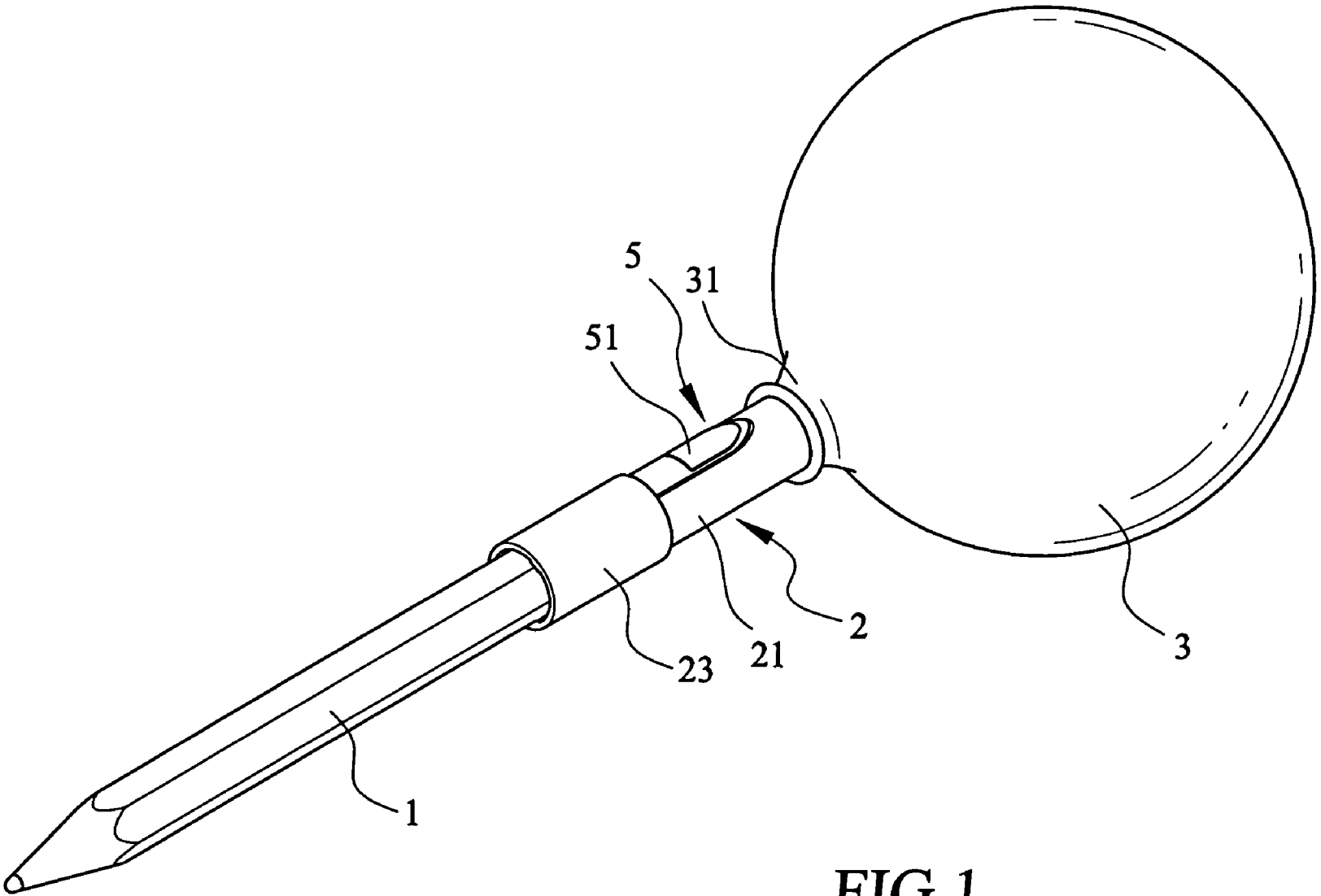
FIG. 1 is a perspective view of a pen instrument with controllable whistle according to a preferred embodiment of the present invention.

Please refer to FIG. 1 that is a perspective view of a pen instrument with controllable whistle according to a preferred embodiment of the present invention. As shown, the present invention includes a pen instrument 1 and a whistle 2 mounted to a rear end of the pen instrument 1. A balloon 3 may be connected to the other end of the whistle 2 opposite to the pen instrument 1.

Figure 2:
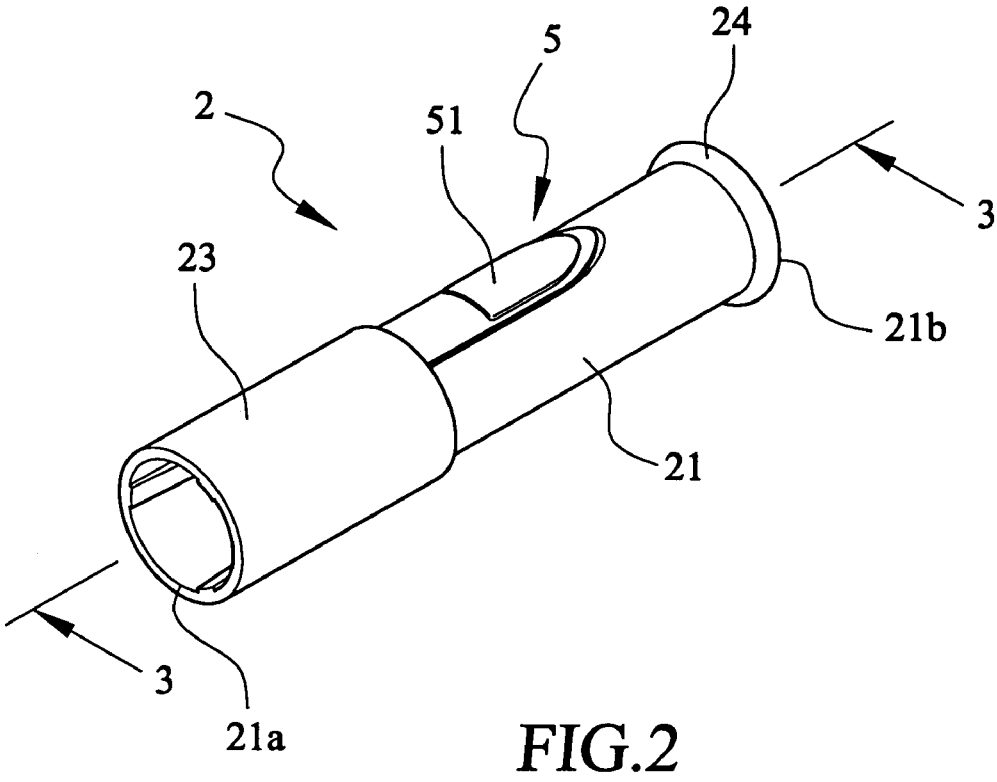
FIG. 2 is a perspective view of a whistle included in the present invention.
Figure 3:
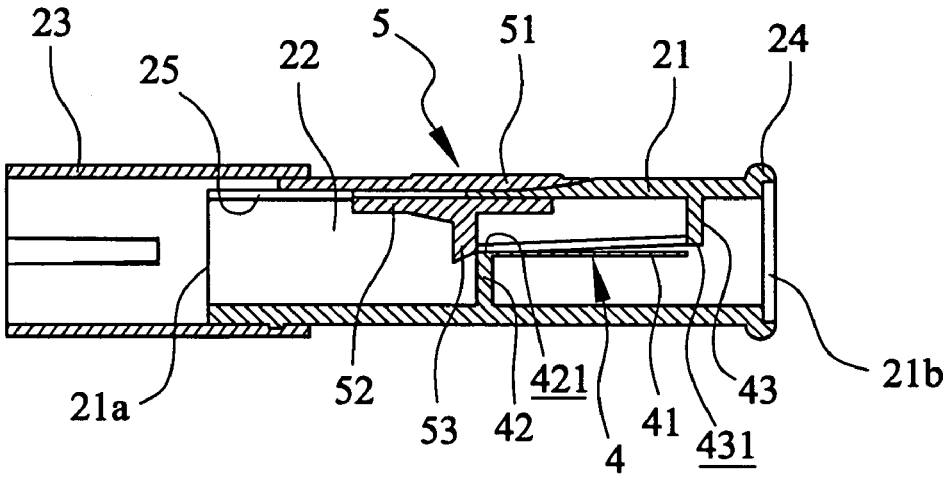
FIG. 3 is a sectional view taken along line 3—3 of FIG. 2.
Figure 4:
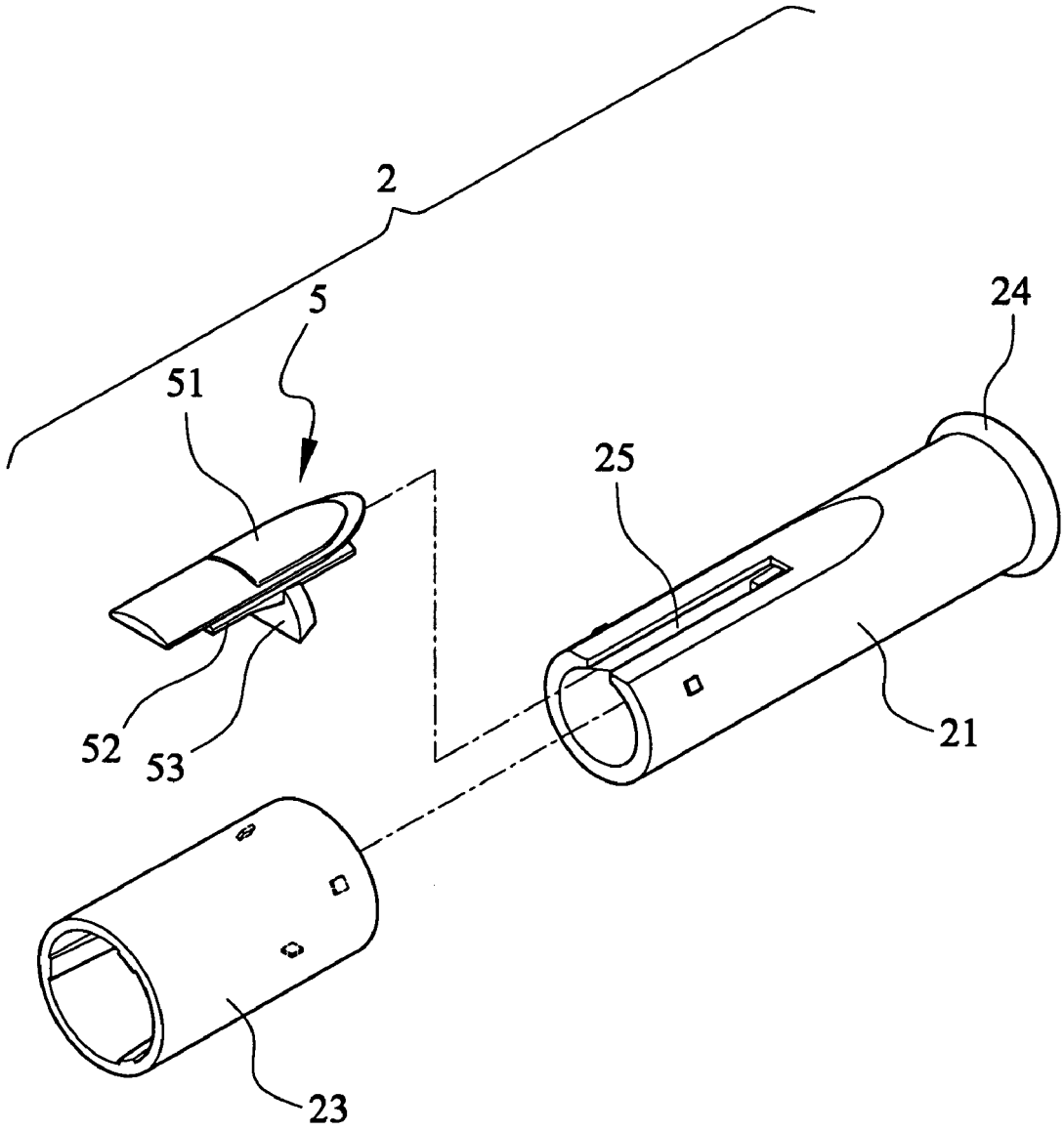
FIG. 4 is an exploded perspective view of the whistle of FIG. 2.

FIGS. 2 and 4 are assembled and exploded perspective views, respectively, of the whistle 2, and FIG. 3 is a sectional view taken along line 3—3 of FIG. 2. As shown, the whistle 2 includes a tubular body 21 defining an inner space 22 and having two open ends, namely, a first open end 21*a* and a second open end 21*b*, and a connecting sleeve 23 having a front end connected to a rear end of the pen instrument 1 and a rear end removably connected to the first open end 21*a* of the tubular body 21.

Figure 5:
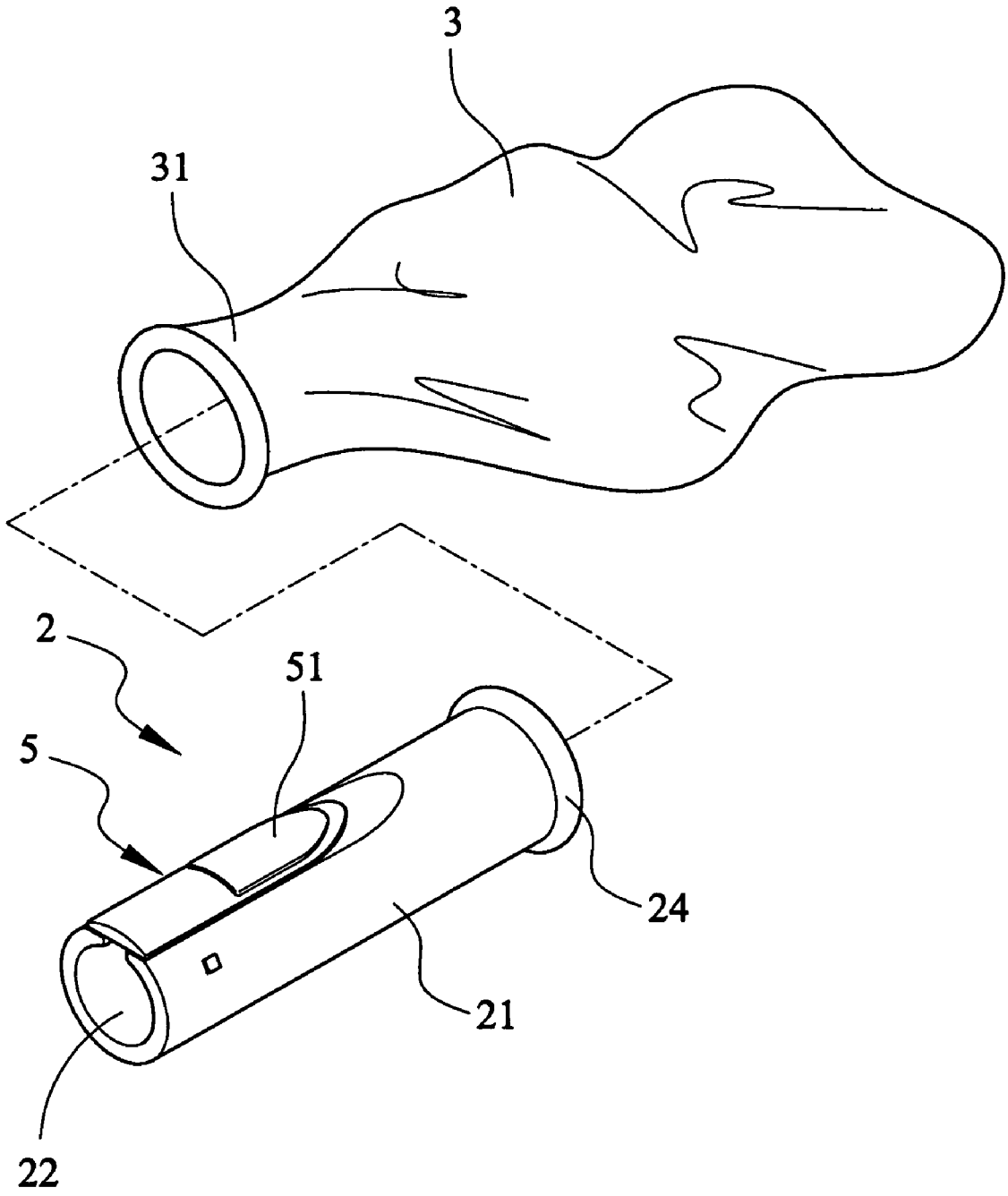
FIG. 5 is a perspective view showing the connection of a balloon to a tubular body of the whistle of the present invention.
Figure 6:
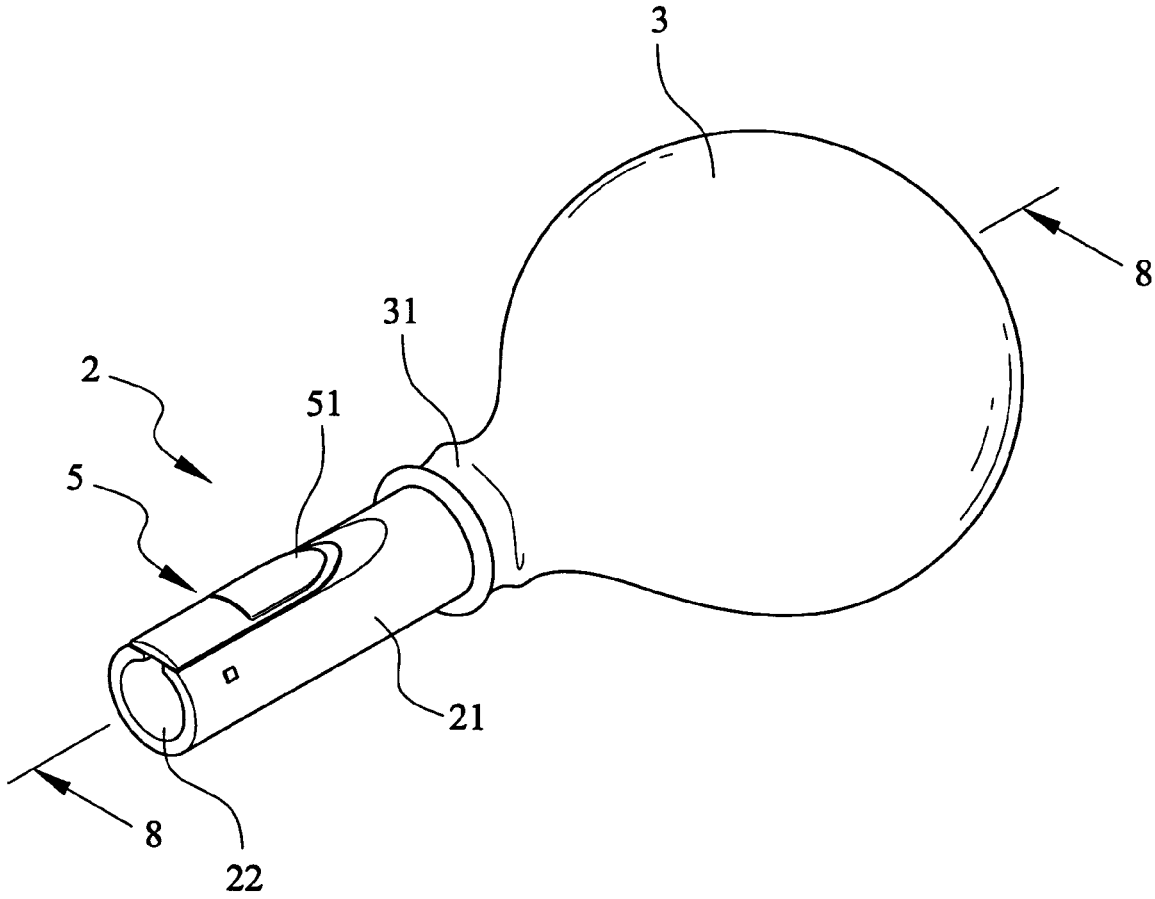
FIG. 6 shows the balloon connected to the tubular body of the whistle of the present invention is inflated.

The tubular body 21 is formed around the second open end 21*b* with a radially expanded annular flange 24 for a neck 31 of the balloon 3 to firmly engage therewith, as shown in FIG. 5. FIG. 6 shows the balloon 3 connected to the second open end 21*b* of the tubular body 21 of the whistle 2 in an inflated state.

As can be seen from FIG. 3, the tubular body 21 of the whistle 2 has a whistle-producing reed structure 4 formed in the inner space 22 and including a reed 41, a first dam 42, and a second dam 43. The first dam 42 is a semicircular wall projected from an inner wall of the tubular body 21 into the inner space 22 in a first radial direction to define a flat top 421, which is located close to a radial middle point of the inner space 22 to block almost one half of an air passage defined in the inner space 22.

The second dam 43 is also a semicircular wall projected from an inner wall of the tubular body 21 into the inner space 22 in a second radial direction opposite to the first radial direction to define a flat top 431, which is located close to the radial middle point of the inner space 22 to block almost one half of the air passage defined in the inner space 22. The second dam 43 is spaced from and located behind the first dam 42 by a predetermined distance in the tubular body 21 relative to the first open end 21*a*.

The reed 41 has an end fixedly connected to the flat top 421 of the first dam 42, and an opposite free end extended toward the flat top 431 of the second dam 43 with a predetermined clearance existed between the free end of the reed 41 and the flat top 431 of the second dam 43. Whereby, when an amount of air flows through the clearance between the second dam 43 and the reed 41, the reed 41 is vibrated to produce whistle.

As can be seen from FIGS. 3 and 4, the tubular body 21 of the whistle 2 is provided at one side with a slot 25 that axially extends from the first open end 21*a* toward the second open end 21*b* by a predetermined distance for a cut-off device 5 to slidably mounted therein. The cut-off device 5 includes a push plate 51 and a slide 52 beneath the push plate 51. The push plate 51 has two ends axially projected from two ends of the slide 52, and is slightly raised from an outer surface of the tubular body 21 for a user to shift the cut-off device 5 forward or rearward conveniently. The slide 52 is associated with a baffle radially extended from a radially inner side of the slide 52 into the inner space 22.

Figure 7:
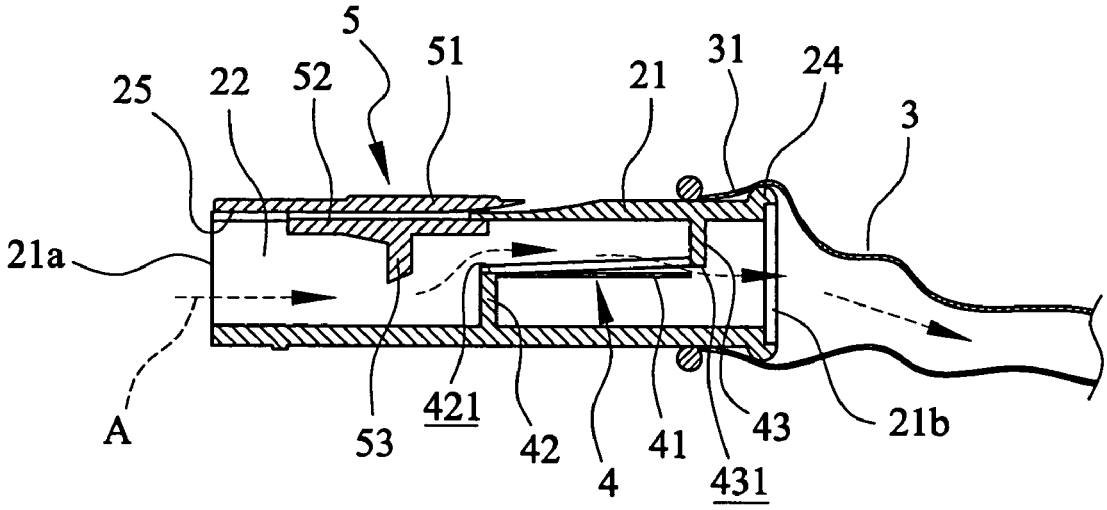
FIG. 7 is a sectional view of the whistle of the present invention with a cut-off device thereof in a first or inflating position to let in air for inflating the balloon.

The cut-off device 5 is slidably moved in the slot 25 between a first or inflating position and a second or cut-off position. When the cut-off device 5 is moved to the first position as shown in FIG. 7, the air passage in the tubular body 21 is open for air A to flow from the first open end 21*a* toward the second open end 21*b* into the balloon 3 to inflate the latter.

Figure 8:
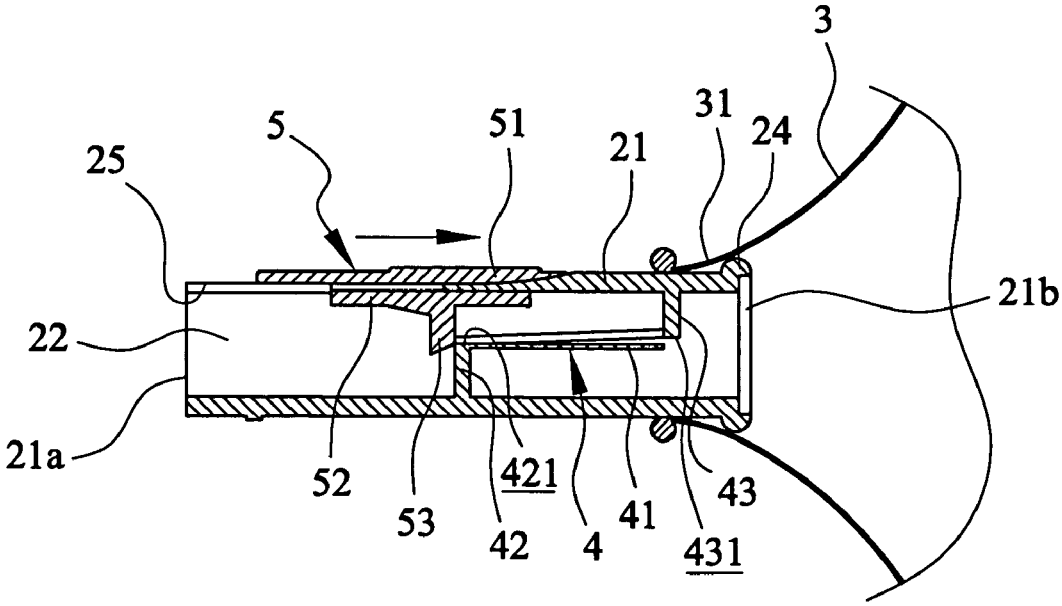
FIG. 8 is a sectional view taken along line 8—8 of FIG. 6 showing the cut-off device is in a second or cut-off position to prevent the balloon from deflating.

When the cut-off device 5 is moved to the second position as shown in FIG. 8, the baffle 53 is in close contact with the flat top 421 of the first dam 42 of the whistle-producing reed structure 4 to completely block the air passage in the tubular body 21, so that air is kept in the inflated balloon 3.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A pen instrument with a whistle mounted to a rear end of said pen instrument, said whistle comprising:

a tubular body having a first open end and a second open end, and defining an inner space;

a connecting sleeve having a rear end connected to the first open end of said tubular body, and a front end connected to a rear end of said pen instrument, so as to connect said whistle to said pen instrument;

a whistle-producing reed structure fixedly provided in said inner space of said tubular body and including a reed, said reed being adapted to produce whistle when an amount of air flows through said inner space of said tubular body to vibrate said reed; and a cut-off device provided in said tubular body at a predetermined position operable by a user to move between a first position, in which said inner space of said tubular body is open to allow air to flow from said first open end to said second open end of said tubular body, and a second position, in which said inner space of said tubular body is blocked to prevent air from flowing between said first open end and said second end.

2. The pen instrument as claimed in claim 1, wherein said whistle-producing reed structure further comprises a first dam and a second dam;

said first dam being a semicircular wall projected from an inner wall of said tubular body into said inner space in a first radial direction to define a flat top, which is located close to a radial middle point of said inner space to block one half of an air passage defined in said inner space; and said second dam being a semicircular wall projected from an inner wall of said tubular body into said inner space in a second radial direction opposite to the first radial direction to define a flat top, which is located close to the radial middle point of said inner space to block one half of the air passage defined in said inner space; said second dam being spaced from and located behind said first dam by a predetermined distance in said tubular body relative to said first open end; and said reed having an end fixedly connected to said flat top of said first dam, and an opposite free end extended toward said flat top of said second dam with a predetermined clearance existed between the free end of said reed and said flat top of said second dam; whereby when an amount of air flows through the clearance between said second dam and said reed, said reed is vibrated by the air to produce whistle.

3. The pen instrument as claimed in claim 1, wherein said connecting sleeve is removably connected to said first open end of said tubular body.

4. The pen instrument as claimed in claim 1, further comprising a balloon connected to said second open end of said tubular body.

5. The pen instrument as claimed in claim 4, wherein said tubular body is formed along said second open end with a radially expanded flange for said balloon to firmly connected to said second open end.

6. The pen instrument as claimed in claim 1, wherein said cut-off device includes a push plate and a slide beneath said push plate; said push plate having two ends axially projected from two ends of said slide, and being slightly raised from said tubular body via an axial slot provided on said tubular body; and said slide being associated with a baffle radially extended from a radially inner side of said slide into said inner space of said tubular body.

* * * * *